US007309681B2

(12) United States Patent
Cartwright

(10) Patent No.: US 7,309,681 B2
(45) Date of Patent: Dec. 18, 2007

(54) ASHLESS LUBRICATING OIL COMPOSITION WITH LONG LIFE

(75) Inventor: S. James Cartwright, Sarnia (CA)

(73) Assignee: ExxonMobil Research and Engineering Company, Annandale, NJ (US)

( * ) Notice: Subject to any disclaimer, the term of this patent is extended or adjusted under 35 U.S.C. 154(b) by 469 days.

(21) Appl. No.: 10/830,771

(22) Filed: Apr. 23, 2004

(65) Prior Publication Data

US 2004/0248745 A1 Dec. 9, 2004

Related U.S. Application Data

(60) Provisional application No. 60/467,338, filed on May 2, 2003.

(51) Int. Cl.
*C10M 141/00* (2006.01)
*C10M 141/10* (2006.01)
*C10M 137/10* (2006.01)

(52) U.S. Cl. ..... 508/438; 508/421; 508/433

(58) Field of Classification Search ..... 508/438, 508/421, 433

See application file for complete search history.

(56) References Cited

U.S. PATENT DOCUMENTS

| | | | | |
|---|---|---|---|---|
| 3,767,577 | A * | 10/1973 | Boggs | 585/24 |
| 3,873,464 | A * | 3/1975 | Bieber et al. | 252/78.5 |
| 4,186,102 | A * | 1/1980 | Malec | 508/225 |
| 5,569,405 | A * | 10/1996 | Nakazato et al. | 508/192 |
| 5,869,184 | A * | 2/1999 | Oishi et al. | 428/402.24 |
| 6,001,780 | A * | 12/1999 | Ho et al. | 508/192 |
| 6,465,400 | B1 * | 10/2002 | Kamimura et al. | 508/480 |
| 6,503,872 | B1 * | 1/2003 | Tomaro | 508/377 |
| 2002/0086802 | A1 * | 7/2002 | Cain | 508/185 |
| 2004/0214729 | A1 * | 10/2004 | Buitrago | 508/272 |
| 2005/0026792 | A1 * | 2/2005 | Cartwright | 508/365 |
| 2005/0054543 | A1 * | 3/2005 | Cartwright | 508/376 |
| 2006/0116302 | A1 * | 6/2006 | Deckman et al. | 508/460 |

* cited by examiner

*Primary Examiner*—Anhtuan T. Nguyen
*Assistant Examiner*—Amy T. Lang
(74) *Attorney, Agent, or Firm*—Joseph J. Dvorak; Joseph A. Allocca

(57) ABSTRACT

An ashless natural gas engine lubricating composition which has enhanced resistance to oxidation, nitration and viscosity increase employs as additives in a lubricating oil basestock a combination of phenolic and alkylthiocarbamoyl antioxidants and an ashless phosphorous antiwear additive.

18 Claims, No Drawings

ASHLESS LUBRICATING OIL COMPOSITION WITH LONG LIFE

This application claims the benefit of U.S. Ser. No. 60/467,338 filed May 2, 2003.

FIELD OF INVENTION

The present invention relates to gas engine oils. More particularly the present invention relates to ashless gas engine oils that provide enhanced resistance to oxidation, nitration and viscosity reduction.

BACKGROUND OF INVENTION

Typical natural gas fired engines, such as those used in the petroleum industry to compress natural gas at well heads and along pipelines, have up to 16 cylinders, often generating between 500 to 3000 HP. These engines normally are run continuously near full load conditions with shut downs primarily being for maintenance such as for oil changes. The continuous operation near full load, of course, places severe demands on the engine lubricant. Indeed, because the lubricant is subjected to a high temperature environment oxidation processes occur which limit lubricant life. Also, natural gas engines emit nitrogen oxides ($NO_x$) some of which comes into contact with the lubricant resulting in nitration processes that also will limit lubricant life. Typically these processes are accompanied by increases in oil viscosity. Thus it is desirable to extend the life of gas engine oils by enhancing the oil's resistance to oxidation and nitration and to reduce viscosity increases in the oil.

To extend lubricant life, base oils are formulated with various additives such as dispersants, detergents, antioxidants, viscosity index improvers and the like, to provide a lubricating oil composition. This art of lubricating oil formulation, however, has become increasingly complex with ever more stringent requirements of end-users. Indeed, experience has shown that incorporation of one type of additive in a lubricant composition can have a negative impact on the function of another type of additive. Consequently extensive research continues in the quest for lubricants of improved life and function. Additionally, gas engine oil lubricants are typically formulated with metal containing detergents and metal containing antiwear additives to provide lubricant ash that functions to protect the valve and seat interface of the engine. The ability to provide an ashless gas engine oil, i.e., one having an ash level as determined by ASTM test method D874 below 0.1 mass %, that has enhanced life is particularly difficult.

One object of the present invention is to provide an ashless gas engine lubricating composition that has enhanced resistance to oxidation and nitration.

Another object of the invention is to provide an ashless gas engine oil lubricating composition that has improved life as evidenced by reduction in viscosity increase.

SUMMARY OF INVENTION

Accordingly, an ashless natural gas engine lubricating composition having enhanced resistance to oxidation, nitration and viscosity increase comprises:

a major amount of a lubricating oil basestock;

an effective amount of an ashless antioxidant additive combination comprising both a phenolic antioxidant and alkylthiocarbamoyl;

an effective amount of an ashless phosphorous antiwear additive.

In a preferred embodiment the composition of the invention includes an ashless phosphite antioxidant.

DETAILED DESCRIPTION OF INVENTION

The lubricating oil composition of the invention comprises a major amount of a lubricating oil basestock which may be a mineral oil, synthetic oil or blends of oils to give a basestock of the desired viscosity for a natural gas engine oil. Suitable basestocks include those of API categories I, II and III. Typically, the basestock of the invention will have a kinematic viscosity at 100° C. in the range of about 5 to about 16 cSt and preferably 10 to 13 cSt.

The composition of the present invention includes an effective amount of an ashless antioxidant additive combination comprising both a phenolic antioxidant and an alkylthiocarbamoyl antioxidant.

Suitable phenolic antioxidants are hindered phenolic compounds including sulfur-containing hindered phenolic compounds. Typical hindered phenolic compounds may be represented by the following formulae:

[I]

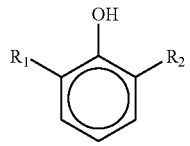

[II]

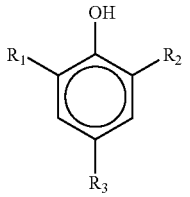

[III]

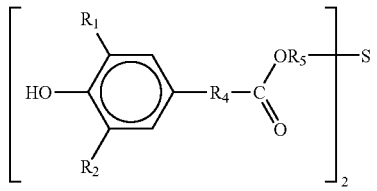

where $R_1$, $R_2$ and $R_3$ are the same or different and represent an alkyl group of 1 to 18 carbon atoms or —$CH_2SR_2$; and $R_4$ and $R_5$ are the same or different alkylene groups of 1 to 3 carbon atoms.

The alkylthiocarbamoyl component of the combined ashless antioxidant additive combination may be represented by the formula:

[IV]

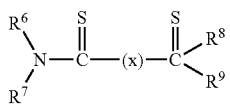

where $R^6$, $R^7$, $R^8$ and $R^9$ are the same or different linear and branched alkyl groups of from 3 to 30 carbon atoms; x is S, S—S, $S(CH_2)_y$—S, S—$CH_2CH(R^{10})S$; y is an integer of 1 to 4; and $R^{10}$ is an alkyl group of 1 to 2 carbon atoms. Preferably $R^6$, $R^7$, $R^8$ and $R^9$ are —$(CH_2)_3CH_3$; x is $S(CH_2)_4$ S; and y is 1.

In general the weight ratio of phenolic antioxidant to alkylthio-carbamoyl antioxidant in the combined antioxidant additive will be in the range of about 5:1 to about 1:5 and preferably 2:1 to 1:2. Also, the amount of the antioxidant combination in the lubricant composition preferably will range from about 0.1 mass % to about 3.0 mass % based on the total mass of the composition.

The composition of the invention includes an effective amount of an ashless phosphorous antiwear additive. Typical examples include phosphoric acid esters such as those represented by the formula:

[V]

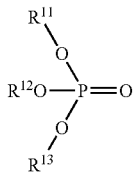

where $R^{11}$, $R^{12}$ and $R^{13}$ are independently an alkyl group, an alkenyl group, an alkylaryl group and an aralkyl group of from 4 to 30 carbon atoms. Preferably the antiwear additive is tri-isopropylphenyl phosphate.

In general the antiwear additive will comprise from about 0.1 mass % to about 2.0 mass % based on the total mass of the composition.

In one embodiment of the present invention the composition may also include an ashless phosphite antioxidant. Suitable phosphite antioxidants may be represented by the formula:

$$P(OR_{14})_3$$

where each $R_{14}$ is independently linear and branched alkyl groups of from 1 to 12 carbon atoms.

When present, the phosphite antioxidant will comprise from about 0.5 mass % to about 2 mass % of the composition.

The composition may contain other standard ashless gas engine oil additives such as ashless dispersants, metal passivators, pour point depressants, viscosity index improvers and antifoamants.

Examples of ashless dispersants include alkenyl succinimides, borated alkenyl succinimides and alkenyl succinic acid.

Examples of viscosity index improvers include polymethacrylate polymers and ethylene-propylene copolymers.

Tolyltriazoles exemplify suitable metal passivators.

Poly methyl methacrylate exemplifies a suitable pour point depressant.

Silicone polymers exemplify suitable antifoamants.

In all of the embodiments herein the composition of the present invention is free of added metal compounds and as a consequence the composition has a sulfated ash content of less than 0.1 mass %.

EXAMPLES

The invention will be further illustrated by the following examples which set forth particularly preferred embodiments and illustrate their advantages.

Table 1 below details a series of experimental formulations which demonstrate the invention. In the Table the Reference Oil is a commercial, ashless gas engine oil using an additive package identified as ESTOR A6×40 supplied by Imperial Oil, Canada. The Reference Oil represents a "standard" against which to measure other oils.

Comparative Oil 1 uses a sulfur containing phenolic antioxidant to achieve enhanced performance.

Comparative Oil 2 uses zinc dialkyldithiophosphate as an antiwear additive.

Example Oils 1, 2 and 3 provide different combinations of ashless phenolic and ashless alkylthiocarbamoyl antioxidants. Example Oil 3 also contains as ashless phosphite antioxidant, namely, tris(2,4-di-t-butyl phenyl)phosphate.

The oils were subjected to a nitration screener test and the results are presented in Table 1. The nitration screener test is a lab test which assesses several facets of the degradation of natural gas engine oils. All results are expressed as a fraction of the results for the Reference Oil. Therefore all results for the Reference Oil will have a result of 1.00 and any results lower than 1.00 signify enhanced performance.

As can be seen Example Oils 1 and 2 provide significantly better oxidation and nitration control compared to the Reference Oil and equivalent thickening control. Comparative Oil 1 lacked the thickening control of Example Oils 1, 2 and 3. Comparative Oil 2 was the poorest performing oil while Example Oil 3 provided the best overall performance.

TABLE 1

| | | Formulation No. | | | | | |
|---|---|---|---|---|---|---|---|
| Component (vol %) | Description | Reference Oil | Comparative Oil 1 | Invention Example 1 | Invention Example 2 | Comparative Oil 2 | Invention Example 3 |
| | Commercial sample | 100.00 | — | — | — | — | — |
| | Group I basestock | — | 92.00 | 92.00 | 92.00 | 92.21 | 92.00 |
| | Balance of Additive System | — | 6.50 | 6.50 | 6.50 | 6.50 | 6.50 |
| | Zinc Dialkyldithiophosphate | — | — | — | — | 0.29 | — |
| | Phenolic antioxidant | — | — | — | 0.50 | 0.50 | 0.50 |
| | Sulphurised Phenolic antioxidant | — | 1.00 | 0.50 | — | — | — |
| | Ashless alkylthiocarbamoyl | — | — | 0.50 | 0.50 | 0.50 | 0.50 |
| | Ashless P antiwear additive | — | 0.50 | 0.50 | 0.50 | — | 0.50 |
| | Ashless phosphite antioxidant | — | — | — | — | — | 0.50 |
| | | | | | | | mass % |

TABLE 1-continued

| Component (vol %) | Description | Formulation No. Reference Oil | Comparative Oil 1 | Invention Example 1 | Invention Example 2 | Comparative Oil 2 | Invention Example 3 |
|---|---|---|---|---|---|---|---|
| Kinematic Viscosity, cSt | measured Kv @ 100° C. | 13.39 | 13.37 | 13.36 | 13.30 | 13.47 | 13.35 |
| Nitration Screener Test | Reference Oil | ✓ | | | | | |
| | oxidation (relative) | 1.00 | 0.74 | 0.73 | 0.71 | 0.99 | 0.72 |
| | nitration (relative) | 1.00 | 0.73 | 0.77 | 0.78 | 0.97 | 0.69 |
| | viscosity increase (relative) | 1.00 | 1.12 | 0.99 | 1.01 | 1.54 | 0.91 |

What is claimed is:

1. A method for the lubrication of a natural gas-fired engine comprising lubricating the engine with an ashless lubricating oil comprising:

(i) a major amount of a lubricating oil base stock having a viscosity suitable for a natural gas-fired engine in the range of about 5 to about 16 cSt at 100° C., (ii) an effective amount of an ashless antioxidant additive combination comprising both a phenolic antioxidant and an alkylthiocarbamoyl compound in the mass ratio in the range of about 5:1 to 1:5; and (iii) an effective amount of an ashless phosphorous antiwear additive, wherein the oxidation resistance, nitration resistance and resistance to viscosity increase are all improved as compared to lubricating the engine with a lubricating oil composition which does not contain all three additives.

2. The method of claim 1 wherein the antioxidant additive combination (ii) comprises about 0.1 mass % to about 3.0 mass % of the total mass of the composition.

3. The method of claim 2 wherein the phenolic antioxidant is represented by the formulae:

[I]

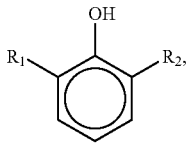

[II]

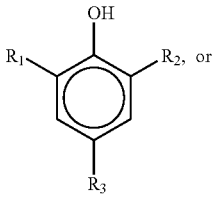

where $R_1$, $R_2$ and $R_3$ are the same or different alkyl groups of 1 to 18 carbon atoms or —$CH_2$ $SR_2$; $R_4$ and $R_5$ are the same or different alkylene groups of 1 to 3 carbon atoms; and wherein the alkylthiocarbamoyl compound is represented by the formula:

[IV]

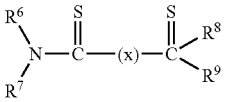

where $R^6$, $R^7$, $R^8$ and $R^9$ are the same or different linear and branched alkyl groups of from 3 to 30 carbon atoms; x is S, S—S, $S(CH_2)_y$—S, S—$CH_2CH(R^{10})S$; y is an integer of 1 to 4; and $R^{10}$ is an alkyl group of 1 to 2 carbon atoms.

4. The method of claim 3 wherein the ashless phosphorous antiwear additive (iii) comprises about 0.1 to 2.0 mass % based on the total mass of the composition.

5. The method of claim 4 wherein the ashless phosphorous antiwear additive is represented by the formula

[V]

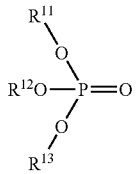

where $R^{11}$, $R^{12}$ and $R^{13}$ are independently an alkyl group, an alkenyl group, an alkylaryl group and an aralkyl group of from 4 to 30 carbon atoms.

6. The method of claim 5 including an effective amount of an ashless phosphite antioxidant.

7. The method of claim 6 wherein the ashless phosphite antioxidant comprises about 0.5 mass % to about 2 mass % of the composition.

8. The method of claim 7 wherein the phosphite antioxidant is represented by the formula $$P(OR_{14})_3$$

where the $R_{14}$'s are independently linear and branched alkyl groups of from 1 to 12 carbon atoms.

9. The method of claim 1 wherein the phenolic antioxidant is a sulfurized phenolic antioxidant.

10. The method of claim 9 wherein the sulfurized phenolic antioxidant is represented by the formulae:

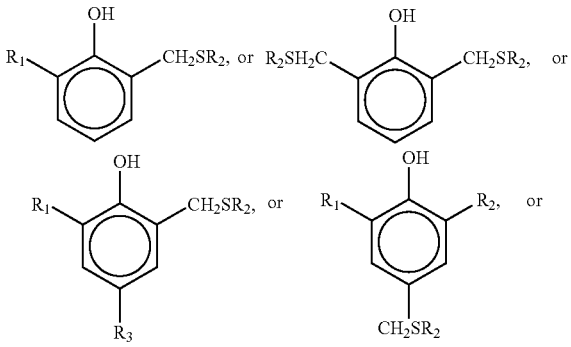

-continued

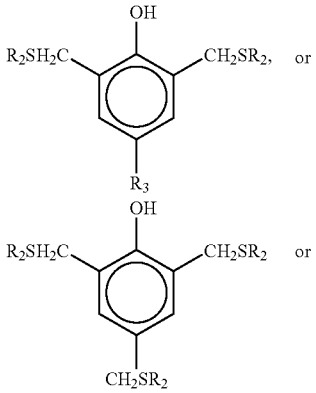

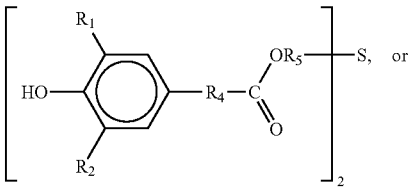

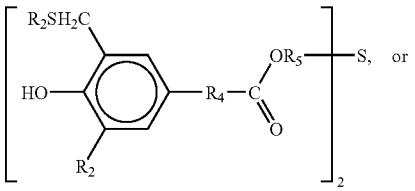

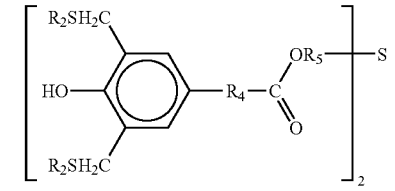

wherein $R_1$, $R_2$ and $R_3$ are the same or different alkyl groups of 1 to 18 carbon atoms; $R_4$ and $R_5$ are the same or different allylene groups of 1 to 3 carbon atoms; and wherein the alkylthiocarbamoyl compound is represented by the formula:

[IV]

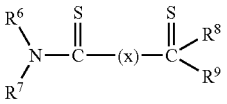

where $R^6$, $R^7$, $R^8$ and $R^9$ are the same or different linear and branched alkyl groups of from 3 to 30 carbon atoms; x is S, S—S, $S(CH_2)_y$—S, S—$CH_2CH(R^{10})S$; y is an integer of 1 to 4; and $R^{10}$ is an alkyl group of 1 to 2 carbon atoms.

11. A method for enhancing the life of ashless natural gas-fired gas engine oils as evidenced by a reduction in oxidation, nitration and viscosity increase of the ashless gas engine oil during use comprising formulation an ashless gas engine oil comprising a major amount of a lubricating oil base stock having a viscosity at 100° C. of from 5 to 16 cSt, an ashless antioxidant additive combination comprising both a phenolic antioxidant and an alkylthiocarbamoyl compound in the mass ratio in the range of about 5:1 to 1:5; the antioxidant combination comprising about 0.1 mass % to about 3.0 mass % of the total mass of the ashless natural gas-tired engine oil and an ashless phosphorous antiwear additive in an amount of about 0.1 to 2.0 mass % based on the total mass of the ashless natural gas-fired engine oil wherein the oxidation resistance, nitration resistance and resistance to viscosity increase are all improved as compared to ashless natural gas fired engine oils which do not contain all three additives.

12. The method of claim 11 wherein the phenolic antioxidant is represented by the formulae:

[I]

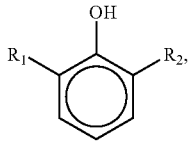

[II]

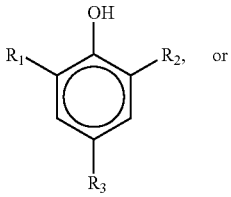

[III]

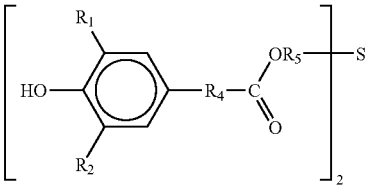

where $R_1$, $R_2$ and $R_3$ are the same or different alkyl groups of 1 to 18 carbon atoms or —$CH_2$ $SR_2$; $R_4$ and $R_5$ are the same or different alkylene groups of 1 to 3 carbon atoms; and wherein the alkylthiocarbamoyl compound is represented by the formula:

[IV]

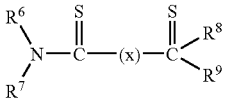

where $R^6$, $R^7$, $R^8$ and $R^9$ are the same or different linear and branched alkyl groups of from 3 to 30 carbon atoms; x is S, S—S, $S(CH_2)_y$—S, S—$CH_2CH(R^{10})S$; y is an integer of 1 to 4; and $R^{10}$ is an alkyl group of 1 to 2 carbon atoms.

13. The method of claim 11 wherein the ashless phosphorous antiwear additive is represented by the formula

[V]

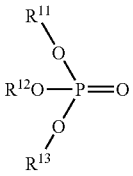

where $R^{11}$, $R^{12}$ and $R^{13}$ are independently an alkyl group, an alkenyl group, an alkylaryl group and an aralkyl group of from 4 to 30 carbon atoms.

14. The method of claim 11 including an effective amount of an ashless phosphite antioxidant.

15. The method of claim 14 wherein the ashless phosphite antioxidant comprises about 0.5 mass % to about 2 mass % of the composition.

16. The method of claim 15 wherein the phosphite antioxidant is represented by the formula $$P(OR_{14})_3$$

where the $R_{14}$'s are independently linear and branched alkyl groups of from 1 to 12 carbon atoms.

17. The method of claim 11 wherein the phenolic antioxidant is a sulfurized phenolic antioxidant.

18. The method of claim 17 wherein the sulfurized phenolic antioxidant is represented by the formulae:

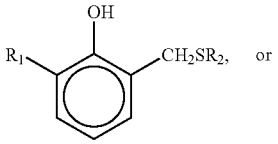

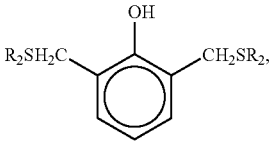

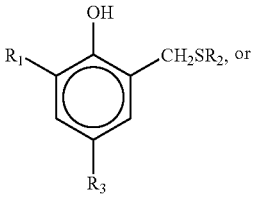

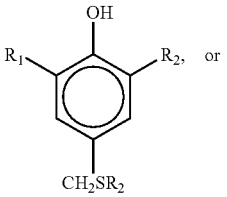

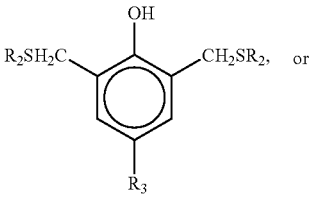

-continued

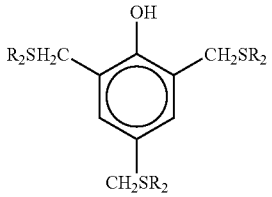

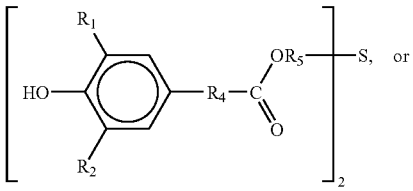

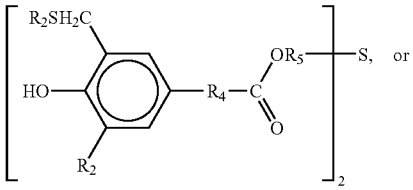

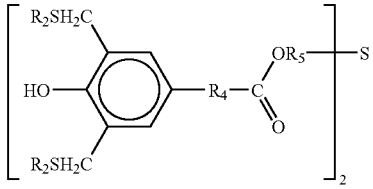

wherein $R_1$, $R_2$ and $R_3$ are the same or different alkyl groups of 1 to 18 carbon atoms; $R_4$ and $R_5$ are the same or different alkylene groups of 1 to 3 carbon atoms; and wherein the alkylthiocarbamoyl compound is represented by the formula:

[IV]

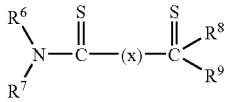

where $R^6$, $R^7$, $R^8$ and $R^9$ are the same or different linear and branched alkyl groups of from 3 to 30 carbon atoms; x is S, S—S, $S(CH_2)_y$—S, S—$CH_2CH(R^{10})S$; y is an integer of 1 to 4; and $R^{10}$ is an alkyl group of 1 to 2 carbon atoms.

* * * * *